US005623955A

United States Patent [19]

Sewell

[11] Patent Number: 5,623,955

[45] Date of Patent: Apr. 29, 1997

[54] SHAVING EQUIPMENT

[76] Inventor: Miles A. B. Sewell, 47 Norfolk Road, Maidenhead, Berkshire, England, SL6 7AU

[21] Appl. No.: 307,856

[22] PCT Filed: Apr. 1, 1993

[86] PCT No.: PCT/GB93/00681

§ 371 Date: Dec. 1, 1994

§ 102(e) Date: Dec. 1, 1994

[87] PCT Pub. No.: WO93/19638

PCT Pub. Date: Oct. 14, 1993

[30] Foreign Application Priority Data

Apr. 1, 1992 [GB] United Kingdom ..... 9207177

[51] Int. Cl.[6] ..... A45D 42/14

[52] U.S. Cl. ..... 132/291; 248/467

[58] Field of Search ..... 132/286, 289, 132/291; D28/64.1, 64.3; 248/467; 359/871; 30/90, 40, 40.2

[56] References Cited

U.S. PATENT DOCUMENTS

| | | | |
|---|---|---|---|
| 2,221,238 | 11/1940 | Johnson | 248/206 |
| 2,319,727 | 5/1943 | Duggan | 248/206 |
| 3,869,183 | 3/1975 | Frank Jr. . | |
| 4,611,716 | 9/1986 | Sorlien . | |
| 4,655,559 | 4/1987 | Odell . | |
| 4,733,468 | 3/1988 | Zadro | 132/291 |
| 4,832,475 | 5/1989 | Daniels | 248/467 |
| 4,848,542 | 7/1989 | Burnette et al. . | |
| 4,889,141 | 12/1989 | Lindsey . | |
| 4,950,065 | 8/1990 | Wyman . | |
| 5,093,748 | 3/1992 | Higdon | 248/467 |

FOREIGN PATENT DOCUMENTS

| | | |
|---|---|---|
| 2103074 | 4/1972 | France . |
| 2129295 | 5/1984 | United Kingdom . |

*Primary Examiner*—Todd E. Manahan
*Attorney, Agent, or Firm*—Renner, Otto, Boisselle & Sklar

[57] ABSTRACT

Shaving equipment which includes a mirror, a first attachment device for releasably attaching the mirror to a wall or the like, and a second attachment device for releasably attaching a razor to the equipment. The first and second attachment devices are disposed respectively behind and in front of the mirror. Preferably, the first attachment device, for example a sucker, is hidden from normal view.

14 Claims, 2 Drawing Sheets

SHAVING EQUIPMENT

FIELD OF THE INVENTION

BACKGROUND AND SUMMARY OF THE INVENTION

This invention relates to shaving equipment.

It is, of course, commonplace to use a glass mirror permanently mounted on a wall or bathroom cabinet as a shaving mirror. Also, portable glass shaving mirrors are known which can be stood on a shelf or ledge. However, these known portable shaving mirrors are of little use if a suitable shelf or ledge is not available, for example in a shower, and furthermore, in this case, there may be nowhere close to hand to put the razor after a shave. Also, these known mirrors are prone to misting up in a bathroom atmosphere.

This invention is more particularly concerned with shaving equipment of the type comprising a mirror, first means for releasably attaching the mirror to a wall or the like, and second means for releasably attaching a razor to the equipment.

An example of such equipment is known from patent specification U.S. Pat. No. 4,655,559. In that known equipment, the mirror is provided on the front of a reservoir, from the bottom of which a pin projects. The pin fits into a socket in a bracket which is connected by a ball and socket joint to a sucker for attachment to a wall. The bracket also has a rack for holding a grooming article, such as a razor. By disconnecting the pin and socket joint, the mirrored reservoir can be removed for emptying and recharging with hot water to reduce the tendency of the mirror to fog-up. The equipment of U.S. Pat. No. 4,655,559 is complicated and is not particularly aesthetically pleasing. Also, the pin and socket connection provides a weak link susceptible to breakage.

In accordance with one aspect of the present invention, shaving equipment of the general type mentioned above is characterised in that the first and second attaching means are disposed respectively behind and in front of the mirror. Accordingly, the first attaching means (to the wall or the like) can be hidden from normal view.

Preferably, the first and second attaching means are attached to the mirror at or adjacent the same location on the mirror, and, in particular, the first attaching means may comprise a member which passes through a hole in the mirror and also forms at least part of the second attaching means. This therefore provides a simple rugged and reliable construction, it being simpler to provide a hole through the mirror rather than a projecting pin as in U.S. Pat. No. 4,655,559.

In one embodiment, the member has a sucker portion behind the mirror for attachment to a wall or the like, a stem portion which passes through the hole in the mirror, and a loop or hook portion in front of the mirror to which a razor can be attached. The sucker can therefore be hidden from normal view, leaving just the mirror and the loop or hook portion visible.

In another embodiment, the member has a sucker portion behind the mirror for attachment to a wall or the like, a stem portion which passes through a hole in the mirror, and means for attaching the stem portion to a razor cassette in front of the mirror to which a razor can be attached. Again, therefore, the sucker can be hidden from normal view, leaving just the mirror and razor cassette visible. In this embodiment, the means for attaching the stem portion to the razor cassette may conveniently comprise a further sucker in front of the mirror, or a tab which can be secured through a slot in the razor cassette.

For simplicity, the member may be a one piece element. Alternatively, the first and second elements may be joined in the region of the stem portion.

In the case where a sucker is provided, a venting means may also be provided to facilitate release of the sucker from the wall, rather than requiring the sucker simply to be ripped away from the wall. Once released, the equipment may be held under the shower or other hot water supply for a few seconds and then re-attached to the wall. It has been found that, when used in a shower, holding the mirror under the shower for about five seconds will heat the mirror sufficiently to prevent it fogging up for the time taken to have a shave.

For stability, the first and second attaching means may be disposed towards the top of the mirror, unlike the equipment of U.S. Pat. No. 4,655,559 which is top heavy.

As mentioned above, in the equipment of U.S. Pat. No. 4,655,559, a razor can be hung on a rack, and the rack is shown as a pair of lugs.

In accordance with a second aspect of the present invention, shaving equipment of the general type mentioned above is characterised in that the second attaching means comprises a cassette for a plurality of razor heads and to which an assembly of a razor head and razor handle can be attached. This second aspect of the invention therefore takes advantage of the popularity of razor assemblies of this type, for which replacement heads are sold in a cassette, to provide not only for attachment of the razor to the mirror, but also for storage of spare razor heads in a convenient place, i.e. by the mirror.

In one embodiment of the first aspect of the invention, the razor cassette is held to the mirror by a further sucker or a tab. Such means may be used in the second aspect of the invention, or alternatively the cassette may be attached to the mirror by a double sucker. Alternatively, in the second aspect of the invention, the first attaching means (for attaching the mirror to the wall or the like) may comprise a wall tile having a recess to receive the mirror, and the tile may have a second recess to receive the razor cassette.

In both aspects of the present invention, the mirror may be a simple plate-like mirror, there being no necessity for the complication of providing a reservoir behind the mirror as in U.S. Pat. No. 4,655,559.

BRIEF DESCRIPTION OF THE DRAWINGS

Specific embodiments of the present invention will now be described, by way of example, with reference to the accompanying drawings, in which.

DETAILED DESCRIPTION

Figure 1:
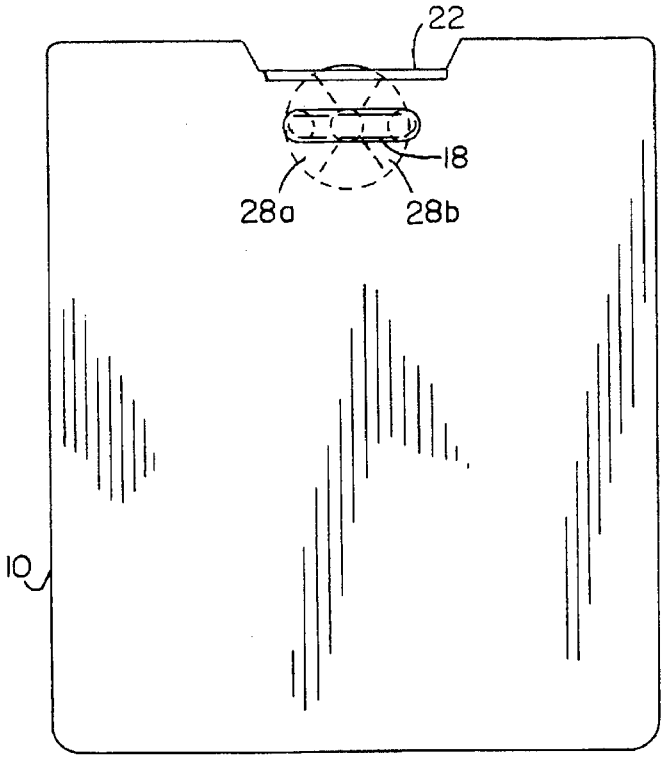
FIG. 1 is a front view of a first embodiment of the shaving equipment.
Figure 2:
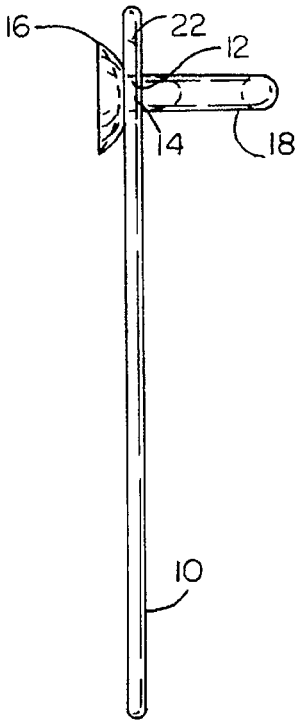
FIG. 2 is a side view of the equipment of FIG. 1.
Figure 3:
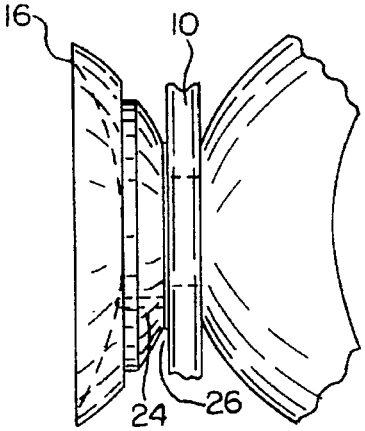
FIG. 3 is an enlarged detailed view of part of FIG. 2.

Referring to FIGS. 1 to 3, the first embodiment of shaving equipment comprises a generally rectangular acrylic mirror 10 having a central hole 12 near its upper edge which receives a stem 14 projecting from a moulded rubber sucker 16 positioned behind the mirror 10. In front of the mirror 10, the stem 14 is formed into a loop 18 through which the handle of a safety razor (not shown) can be downwardly passed so that the loop 18 holds the razor. The center of the top edge of the mirror 10 may have a recess 20 with a bevelled edge 22 to receive the head of the razor and help position it.

As shown in detail in FIGS. 1 and 2, the sucker 16 has a vent hole 24 which is parallel to and offset below its axis and which is normally blocked by a soft rubber sealing disc 26 fixed to the rear of the mirror 10. However, the sealing disc 26 has a pair of cut-outs 28*a*, 28*b* to the left and right so that, if the mirror is twisted about the stem 14 of the sucker 16, the vent hole 24 is opened to vent the sucker and facilitate release from the wall.

In an alternative arrangement, the sealing disc does not have the cut-outs 28*a*, 28*b* and need not be fixed to the mirror. In order to vent the sucker, the lower edge of the mirror is lifted away from the wall so that the sealing disc can lift slightly from the sucker. In a further modification, if the rear surface of the mirror is smooth, there is no need for the sealing disc.

In a modification to the arrangement of FIGS. 1 to 3, the loop 18 is not provided on the stem 14 of the sucker 16, and instead the razor is merely hung on the bevelled edge 22.

Figure 4:
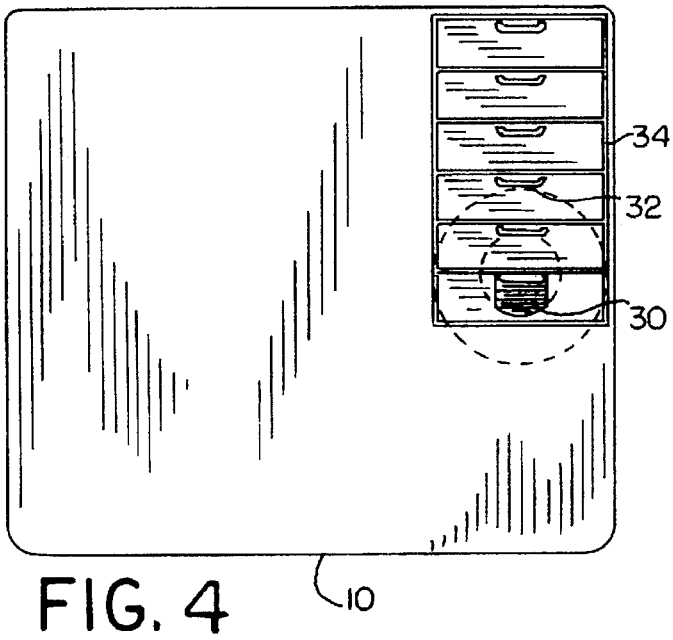
FIG. 4 is a front view of a second embodiment of the shaving equipment.
Figure 5:
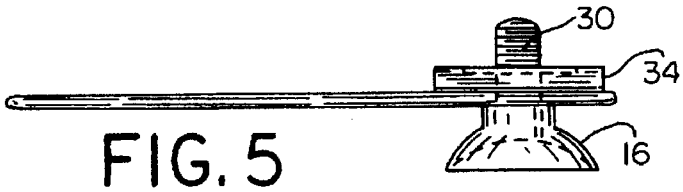
FIG. 5 is a plan view of the equipment of FIG. 4.

Referring to FIGS. 4 and 5, the second embodiment of shaving equipment comprises a generally rectangular acrylic mirror 10 having a hole near its right edge which receives a stem 14 projecting from a moulded rubber sucker 16 positioned behind the mirror. In front of the mirror, the stem 14 is formed into a ribbed tab 30 which passes through and grips in one of several slots 32 in a razor blade cassette 34 and preferably also engages a sharp protrusion in the cassette housing, so that the cassette 34, mirror 10 and sucker 16 are firmly held together. The cassette 34 holds a number of spare or used razor heads and also has a spare space to receive a razor head attached to a razor handle so that the razor assembly of head and handle can be hung from the cassette.

Instead of using the ribbed tab 30 for attaching the cassette the stem 14 of the sucker 16 may be provided with a short screw which can be screwed, in a self-tapping manner, into one of the slots 32 in the cassette 34.

Figure 6:
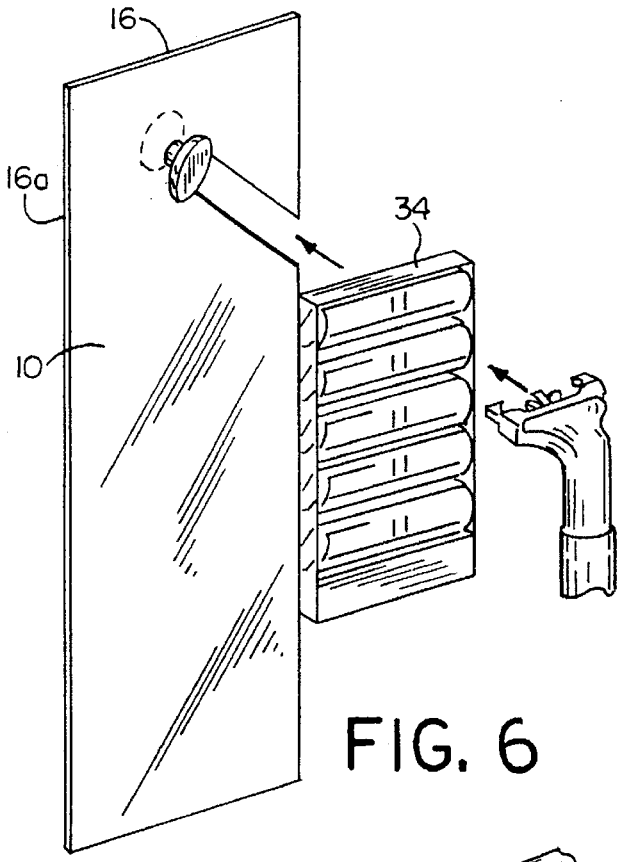
FIG. 6 is a perspective partly-exploded view of a third embodiment of the invention.

FIG. 6 illustrates a third embodiment of the invention which is somewhat similar to FIGS. 4 and 5. However, the sucker 16 is provided adjacent the top-middle of the mirror 10 and the razor cassette is attached to the mirror by a second sucker 16*a*. The two suckers 16, 16*a* may be formed by a single element which is forced through the hole in the mirror during construction, or they may be separate elements connected through the hole by, for example, a small screw, adhesive, or other means.

The arrangement of FIGS. 4 and 5 or FIG. 6 may be provided with the sucker vacuum release valve described above.

Preferably, as shown in the drawings, the shaving equipment does not include a ledge or the like, and therefore if the mirror steams up it can easily be wiped by the hand or forearm, or removed from the wall and immersed in hot water. However, if desired, a small ledge may be provided at the bottom of the mirror on which the razor and a shaving stick and shaving brush may be placed.

It will be appreciated that, although the mirror is shown in the drawings as being generally rectangular, it can be of any desired shape.

Figure 7:
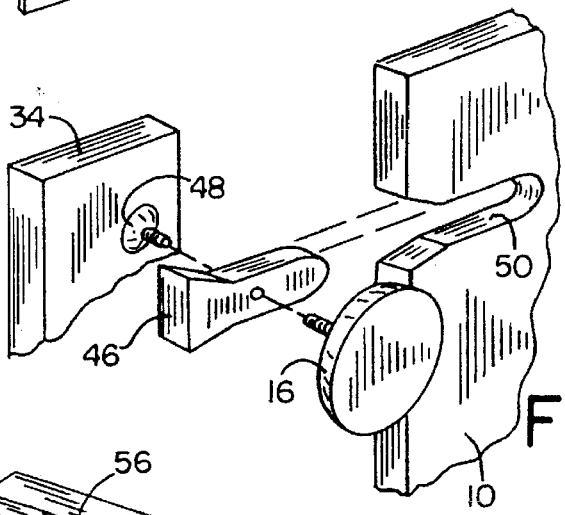

It will also be appreciated that many other modifications may be made to the arrangements described above. For example, as shown in FIG. 7 a sucker 16 for attachment to the wall is fixed to a key block 46 and a further sucker 48 for attaching to the razor cassette is fixed to the opposite side of the key block 46. The mirror 10 has a notch 50 which can jam onto the key block 46.

Figure 8:
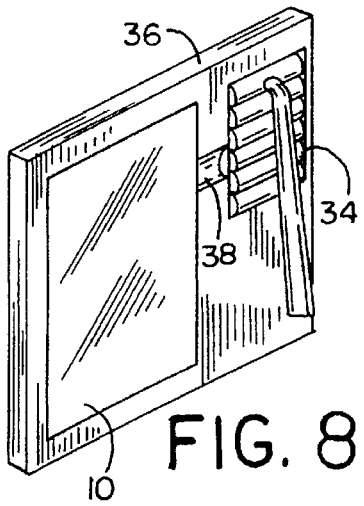
FIGS. 7 to 12 illustrate various alternative embodiments of the invention.

FIG. 8 shows a fourth embodiment of the invention in which a tile 36 of plastics or ceramics material may either be built into a tiled wall or attached to a wall or shower door by a suction cup. The tile 36 has a first recess for releasably receiving the mirror 10 and a second recess for releasably receiving a razor cassette 34. Also, a groove 38 extends between the two recesses to help the user in hooking out the mirror or cassette with his finger.

Figure 9:
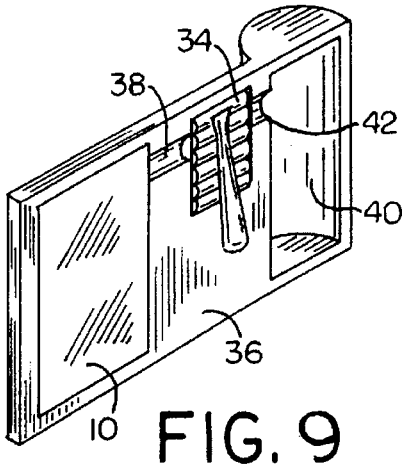

FIG. 9 shows a fifth embodiment of the invention and is somewhat similar to FIG. 8, except that a further recess 40 is provided to receive a tin of shaving foam, and a further finger groove 42 is provided between the razor cassette recess and the shaving foam recess. This arrangement is intended to be built into a wall.

Figure 10:
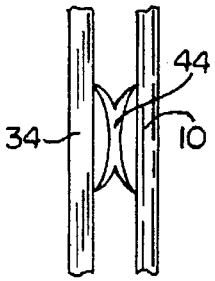

FIG. 10 shows a further arrangement for attaching the razor cassette 34 to the mirror 10 using a double sided sucker 44.

Figure 11:
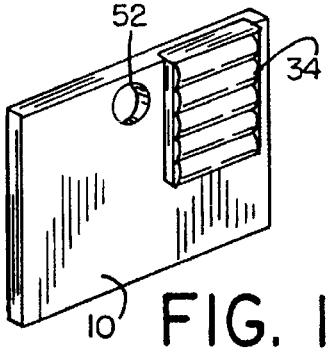

FIG. 11 shows a sixth embodiment of the invention, in which the sucker extends through a hole in the mirror and the free end of the sucker stem is attached to a knob 52 having a marking to assist in aligning the sucker vent hole. Also, the mirror 10 has an open topped recess 54 with slightly tapering vertical sides to receive and grip a razor cassette 34.

Figure 12:
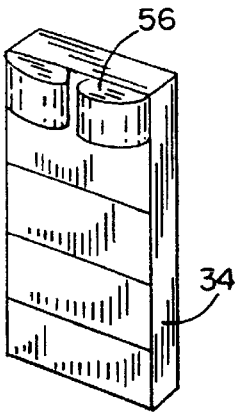

In the arrangement of FIG. 12, a block 56 with a pair of projecting lugs is fitted into one of the spaces in the razor cassette 34 for use in releasably holding the handle of a razor.

I claim:

1. Shaving equipment, comprising:

a mirror;

a sucker disposed behind the mirror for releasably attaching the mirror to a wall;

means disposed in front of the mirror for releasably attaching a razor to the equipment; and means operable to facilitate release of the sucker from the wall;

wherein the sucker and the razor attaching means are attached to the mirror at or adjacent the same location on the mirror; and wherein the sucker has a projection which passes through a hole in the mirror and also forms at least part of the razor attaching means.

2. Shaving equipment as claimed in claim 1, wherein the projection provides a loop or hook portion in front of the mirror to which a razor can be attached.

3. Shaving equipment as claimed in claim 1, further comprising means for attaching the projection to a razor cassette in front of the mirror to which a razor can be attached.

4. Shaving equipment as claimed in claim 1, wherein the means for attaching the projection to a razor cassette comprises a further sucker in front of the mirror.

5. Shaving equipment as claimed in claim 3, wherein the means for attaching the projection to a razor cassette comprises a tab which can be secured through a slot in the razor cassette.

6. Shaving equipment as claimed in claim 1, wherein the sucker, projection and razor attaching means are a one-piece element.

7. Shaving equipment as claimed in claim 1, wherein the sucker, projection and razor attaching means are joined in the region of the stem portion.

8. Shaving equipment comprising:

a mirror;

first means for releasably attaching the mirror to a wall; and second means for releasably attaching a razor to the shaving equipment, the second attaching means comprises a cassette for a plurality of razor heads and to which an assembly of a razor head and a razor handle can be attached.

9. Shaving equipment as claimed in claim 8, wherein the second attaching means further comprises a double sucker for attaching the razor cassette to the mirror.

10. Shaving equipment as claimed in claim 8, wherein the first means comprises a wall tile having a first recess to receive the mirror and a second recess to receive the razor cassette.

11. Shaving equipment, comprising:

a mirror;

a sucker disposed behind the mirror for releasably attaching the mirror to a wall; and means disposed in front of the mirror for releasably attaching a razor to the equipment;

wherein the sucker is connected to the razor attaching means through an aperture through the mirror.

12. Shaving equipment as claimed in claim 11, wherein the aperture through the mirror is a hole.

13. Shaving equipment as claimed in claim 11, wherein the aperture through the mirror is formed by a slot through the mirror extending inwardly from an edge of the mirror.

14. Shaving equipment, comprising:

a mirror;

a sucker disposed behind the mirror for releasably attaching the mirror to a wall;

means disposed in front of the mirror for releasably attaching a razor to the equipment; and means operable to facilitate release of the sucker from the wall; and wherein the sucker, the mirror and the razor attaching means form a one-piece element for removal from the wall at each use.

* * * * *